US005520597A

United States Patent [19]

Tobin

[11] Patent Number: 5,520,597

[45] Date of Patent: May 28, 1996

[54] TRAINER FOR LEARNING TO WALK

[76] Inventor: Robert A. Tobin, 1842 Turk Hill Rd., Fairport, N.Y. 14450-9505

[21] Appl. No.: 517,131

[22] Filed: Aug. 21, 1995

[51] Int. Cl.[6] ..... A63B 22/00; A61H 3/00

[52] U.S. Cl. ..... 482/66; 135/67

[58] Field of Search ..... 482/66, 67, 68, 482/69, 74, 78, 908, 148; 135/67, 65; 280/87.021; 297/6

[56] References Cited

U.S. PATENT DOCUMENTS

| | | | |
|---|---|---|---|
| 2,627,904 | 2/1953 | Thieman | 482/66 |
| 2,900,008 | 8/1959 | Seger | 482/66 |
| 3,442,276 | 5/1969 | Edwards et al. | 482/66 |
| 3,695,609 | 10/1972 | Rothe | 482/66 |
| 4,005,859 | 2/1977 | Tait | 482/66 |

*Primary Examiner*—Stephen R. Crow

[57] ABSTRACT

A light weight trainer to help infants to learn to walk safely, efficiently and effectively. A broad base provides a tip resistant trainer that can be easily and quickly adjusted to a comfortable height for different infants. This trainer can be locked into a folded position of minimum volume for packing, transporting and storage without tools. A scaled up model would provide more security and ease of use to adult users.

7 Claims, 3 Drawing Sheets

TRAINER FOR LEARNING TO WALK

BACKGROUND OF THE INVENTION

1. Field of Invention

The subject invention generally pertains to a device to aid infants and others in learning to walk effectively, efficiently, safely and relatively quickly with the constant help and supervision of an adult.

2. Description of Related Art

Devices to help infants to learn to walk have been around a long time. Each new idea and improvement made the walker more sophisticated and complicated. New additional functions were added like providing a place for the infant to sit and rest (U.S. Pat. No. 153,827 Holman 1874), preventing falling while learning to walk "without the attention of parents or nurse" (U.S. Pat. No. 1,176,048 Gentilella 1916), improving mobility by adding casters, providing eating and/or play area with a tray, reducing required supervision by confining the infant in the walker, providing entertainment by attaching toys, combining options of stroller-walker (U.S. Pat. No. 2,884,046 Patrick 1959), giving option to selectively change the mobility of the walker (U.S. Pat. No. 5,203,581 Jankowski 1993), etc.

These extra features or refinements don't necessarily enhance, and in most cases actually detract from the walkers main mission of developing the infants motor skills, i.e. learning to walk. Many walkers can not be operated on a deep pile carpet. The wheels get embedded or entangled in the carpet.

Surrounding trays, attached toys, etc, block the infants view, especially of the surrounding floor area. Most walkers use wheels, or pads that slide on the floor that can get hung up on the edge of a rug or other object on the floor.

Older children can push, in fun or in mischief, a walker on wheels with an infant in it, into a wall or under a low table resulting in an injury. Infants, with an undeveloped sense of danger, can quickly push themselves into trouble before many adults can react. In 1993 over 25,000 emergency room visits were associated with walkers.

In 1994 the Consumer Product Safety Commission is considering proposals in design changes to reduce injuries caused by walkers. Walkers were associated with eleven deaths between 1989 and 1993.

SUMMARY OF INVENTION

An object of the invention is to maximize the positive results of an infant's efforts to learn to walk.

Another object is to provide a device that can not be moved faster than the using infant can walk.

Another object is to provide maximum visibility of the surroundings to the infant that is learning to walk in order to help him develop depth perception, space relationships and a sense of balance.

Another object is to provide a device that will allow the infant to fall, with the required supervision, safely. Lightweight construction will allow the walker to be pushed out of the way if the child falls against it. We've never seen an infant learn to walk without falling, and falling is probably the best incentive to learn to walk and develop a sense of balance.

Another object is to provide a device that will also function on a deep pile carpet in order to provide the softest impact when the infant does fall.

Another object is to provide a device that is unlikely to be tipped over.

Another object is to provide a device that guides the infant in a straight line, with the direction predetermined by an adult, that can avoid obstacles and unsafe areas. The runners tend to keep the device going straight forward as it is pushed, especially on plush carpet.

Another object is to provide a device that will required close adult supervision for a short period of time (5–20 minutes) each day while the infant is actually learning to walk. The adult is required to protect (spot), help, guide and encourage the infant. Our research indicates the infants will spend more time with the device as their proficiency increases.

Another object is to provide a device that will focus on only having the infant learn to walk, that can be supplemented with jumpers, walkers with wheels, walk behind toys, etc. that can be used for exercise, mobility, playing, entertainment, encouraging exploration, reducing supervision, feeding and all the other developmental activities the infant should have and purposely not provided by this device.

Another feature of this device is to require the user to put his hands near as possible to a natural position for an accomplished walker.

Another feature of this device is the easy adjustment to accommodate a growing infant and infants of different sizes.

Another object of this invention is to provide equal or better support to an infant learning to walk than is now provided by a parent walking behind and holding the infant up by it's hands, or by the infant steadying himself by touching a nearby object such as a piece of furniture or wall. These are probably the oldest and most durable ways infants learn to walk.

Another object of this invention is to provide a device that can go forward or backward so the infant can reverse it's direction simply by turning around while in the trainer. As the infant gains strength and confidence, it will begin to steer this trainer by lifting and pointing one end in the direction he wants to go. This will require more, or less adult supervision depending on how safe the area is, i.e. free of stairs, overhangs, electrical cords and other hazards.

Another feature of this device is it's capability to be folded in to relatively small volume for storage and packing without requiring disassembly and subsequent assembly.

Another object of this invention is to provide a device that can be scaled up to adult proportions for adults who have lost, or are losing, or are regaining their sense of balance and/or their ability to walk. This would offer more stability, and require less strength and skill than the conventional adult walkers presently available.

Another object is to provide a device that the infant can easily escape from if bored, falls, tires, or gets distracted, because learning to walk can be exhilarating, rewarding and fun if it is not encumbered with inescapable confinement.

DESCRIPTION OF THE PREFERRED EMBODIMENT

Figure 1:
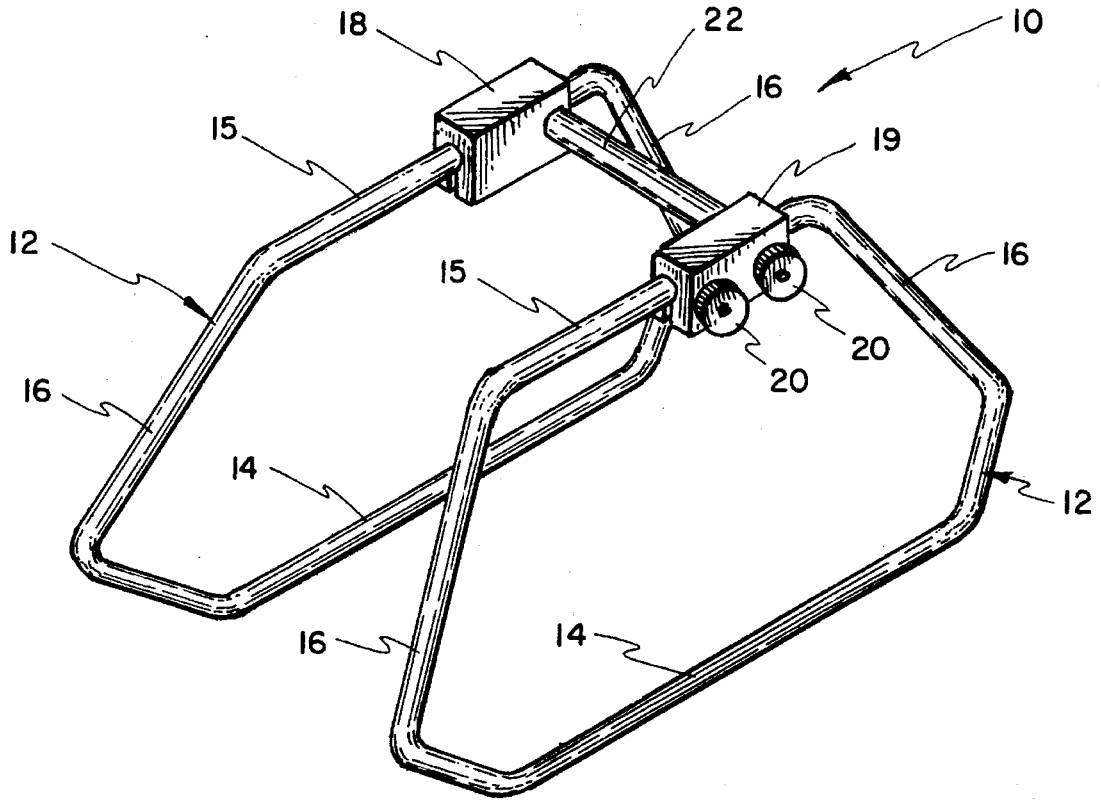
FIG. 1 is a perspective view of the trainer for learning to walk in accordance with this invention.

Referring to FIG. 1, a trainer 10 for learning to walk is illustrated that includes two runner supports 12 composed of a runner section 14, a handle section 15, and two leg sections 16. Both ends of the runner sections 14 are turned up in order to allow the trainer 10 to glide over carpet edges, etc. Left adjustment block 18 and right adjustment block 19 are attached to the handle section 15 of their respective runner supports 12.

Connecting tube 22 is attached to adjustment blocks 18 and 19 and maintains the set distance between the blocks 18 and 19, and maintains both runner sections 14 parallel to each other. The handle sections 15 rotate within the adjustment blocks 18 and 19 when locking knobs 20 are loosened. The handle sections 15 are held firmly in place relative to the adjustment blocks 18 and 19 when locking knobs 20 are tightened.

Figure 2:
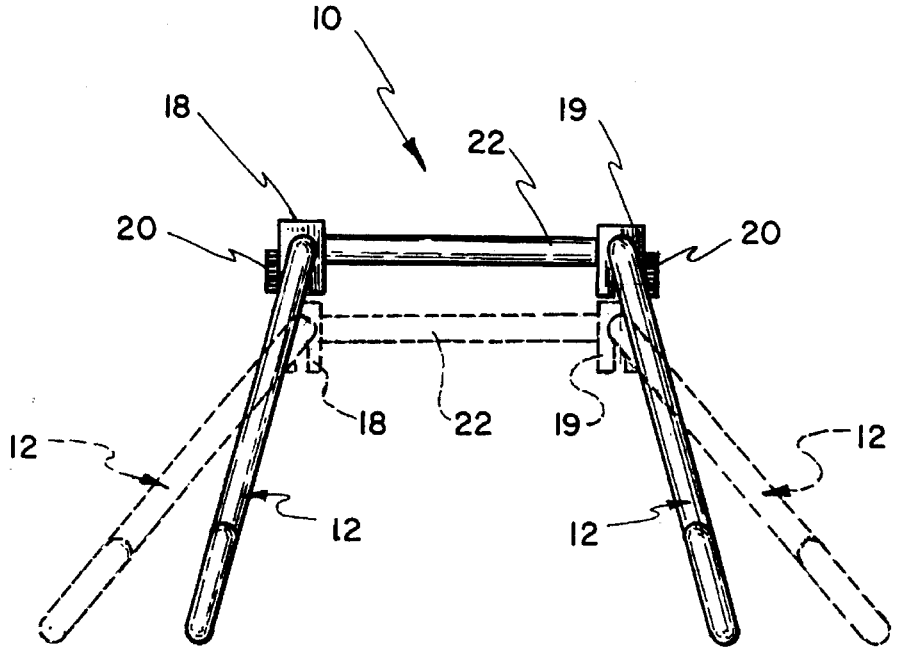
FIG. 2 is an end view showing the trainer adjusted for maximum (solid line) and minimum (broken line) height.

In FIG. 2, the solid line end view of trainer 10 shows the runner supports 12 adjusted for a tall infant. The broken line view of trainer 10 show the runner supports 12 adjusted for a small infant. By loosening locking knobs 20, adjusting runner supports 12, and then tightening locking knobs 20 when connecting robe 22 is parallel to the floor, the trainer 10 can be adjusted to a comfortable height for the using infant.

Figure 3:
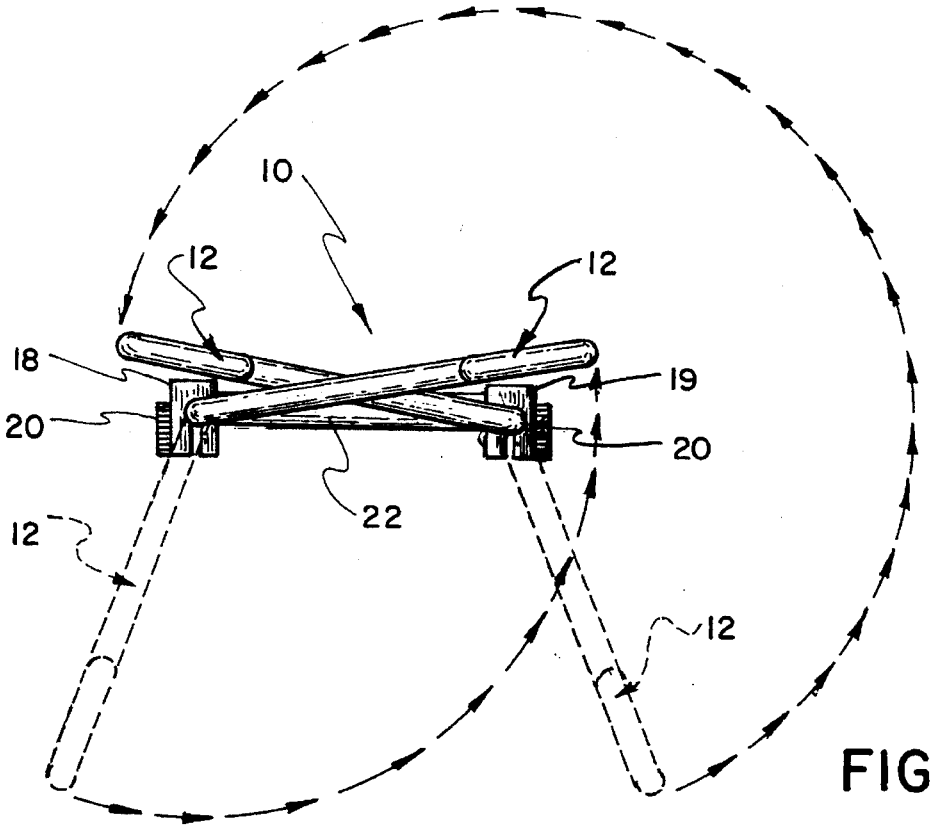
FIG. 3 is an end view of the trainer adjusted for packing, shipping, and storage occupying minimum volume.
Figure 4:
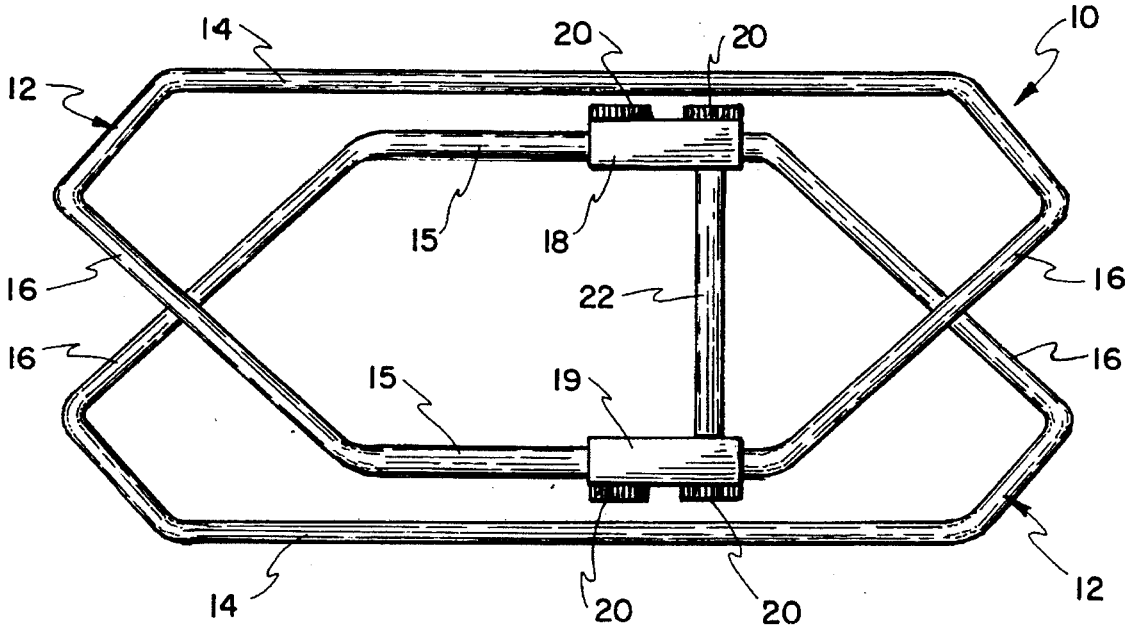
FIG. 4 is a top view of the trainer as depicted in FIG. 3.

In FIG. 3 the runner supports 12 are rotated and locked in place with locking knobs 20 for the most compact position for packing, shipping, and storage of the trainer 10. FIG. 4 shows the top view of the most compact position of trainer 10.

Figure 5:
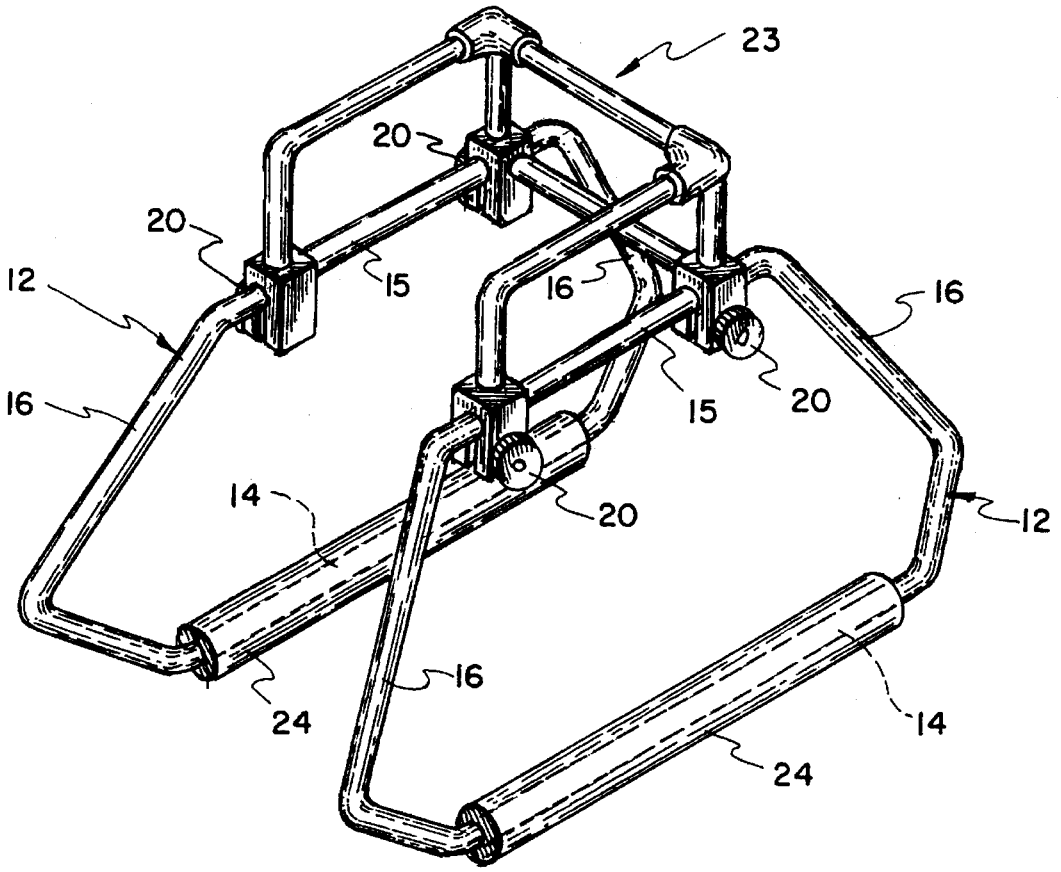
FIG. 5 is a view of a trainer with a handle area enhanced with more options, and an anti-skid attachment for a slippery floor use.

In FIG. 5, the trainer 10 has an enhanced handle area 23 in order to offer more options to the user, and make the trainer more rigid. Anti-skid attachments 24 are put on the trainer 10 in order to use it on hardwood floors or other slippery surfaces.

Figure 6A:
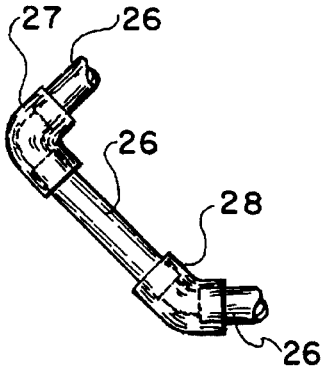
FIG. 6A, 6B, and 6C are views of three of the options of how the runner support can be constructed.
Figure 6B:
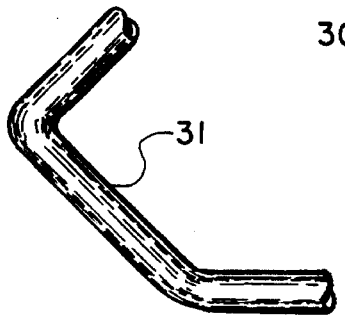
Figure 6C:
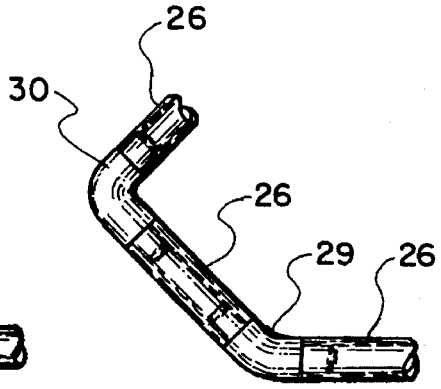

In FIG. 6 some various ways to construct the runner supports 12 are detailed. FIG. 6A show fittings 27 and 28 in which straight tube fits into in order to obtain the required configuration. In FIG. 6B the runner support 10 is obtained by forming one piece of tubing 31. In FIG. 6C, internal fittings 29 and 30 are used in order to eliminate any drag on the runner supports 12 when the trainer 10 is used on a carpet!

Although the invention is described with respect to a preferred embodiment, modifications thereto will be apparent to those skilled in the art. Therefore, the scope of the invention is to be determined by reference to the claims which follow.

What is claimed is:

1. A trainer for learning to walk comprising:

a pair of runner support means for allowing the said trainer to slide across the floor when pushed, and formed from substantially lightweight tubing, said runner support means each comprising an elongated ground engaging section, a handle section, and two leg sections which interconnect said handle section to said ground engaging section;

a connecting means for joining said runner supports together with the said runner sections substantially parallel to each other;

an adjustment means for locking said runner supports in various positions to adjust the handle area of said runner supports at a comfortable height for each individual user, to adjust the relative spacing between said ground engaging sections, and for folding said trainer into a compact configuration for the purpose of packing, transporting, and storing said trainer.

2. The trainer of claim 1 in which said runner supports are fabricated from sections of straight tubes and fittings to provide the required configuration when assembled.

3. The trainer of claim 1 fitted with an anti-skid means for use on hardwood floors or other slippery surfaces.

4. The trainer of claim 1 scaled proportionately larger to accommodate adult users.

5. The trainer of claim 1 with larger runner supports to prevent said trainer from going through standard width doorways even when adjusted for large infants.

6. The trainer of claim 1 wherein said handle section includes upper and lower handle areas.

7. The trainer of claim 6 scaled proportionately larger to accommodate adult users.

* * * * *